US008567872B2

(12) United States Patent
Carr

(10) Patent No.: US 8,567,872 B2
(45) Date of Patent: Oct. 29, 2013

(54) GRINDER BIT

(75) Inventor: Jonathan J. Carr, Vienna, VA (US)

(73) Assignee: Raytheon Company, Waltham, MA (US)

( * ) Notice: Subject to any disclaimer, the term of this patent is extended or adjusted under 35 U.S.C. 154(b) by 690 days.

(21) Appl. No.: 12/233,726

(22) Filed: Sep. 19, 2008

(65) Prior Publication Data

US 2010/0074705 A1 Mar. 25, 2010

(51) Int. Cl.
*E21C 25/00* (2006.01)

(52) U.S. Cl.
USPC ..... 299/39.2; 299/87.1; 299/39.8; 404/90; 37/91

(58) Field of Classification Search
USPC ..... 299/39.4, 79.1, 85.1, 106, 85.2, 102, 299/107, 113, 95, 39.2, 87.1, 39.8; 409/175; 404/90, 91
See application file for complete search history.

(56) References Cited

U.S. PATENT DOCUMENTS

| | | | | |
|---|---|---|---|---|
| 1,790,758 | A | 2/1931 | Montano et al. | |
| 4,444,281 | A | 4/1984 | Schumacher, Jr. et al. | |
| 4,480,873 | A | 11/1984 | Latham | |
| 4,611,673 | A | 9/1986 | Childers et al. | |
| 4,940,099 | A | 7/1990 | Deane et al. | |
| 5,078,540 | A * | 1/1992 | Jakob et al. | 404/90 |
| 5,842,747 | A | 12/1998 | Winchester | |
| 6,193,444 | B1 * | 2/2001 | Jonninen | 405/258.1 |
| 7,036,890 | B2 * | 5/2006 | Hill et al. | 299/85.1 |
| 7,810,888 | B2 * | 10/2010 | Clark et al. | 299/39.4 |

* cited by examiner

*Primary Examiner* — Yong-Suk (Philip) Ro
(74) *Attorney, Agent, or Firm* — Daly, Crowley, Mofford & Durkee, LLP

(57) ABSTRACT

An apparatus for grinding material includes a grinder bit including a drum and a plurality of grinders, at least a portion of the grinders disposed longitudinally in a first helical pattern along the outer surface of the drum. The apparatus further includes a plurality of cleats, at least a portion of the cleats disposed longitudinally in a second helical pattern along the outer surface of the drum. The second helical pattern is offset from the first helical pattern.

16 Claims, 11 Drawing Sheets

GRINDER BIT

STATEMENT REGARDING FEDERALLY SPONSORED RESEARCH

This invention was made with Government support under a contract awarded by the Department of Defense, The Government has certain rights in the invention.

BACKGROUND

Underground mining operations and infrastructure installation projects often require fine excavation and precision grinding of materials and man-made objects, such as earth and concrete. Engineering teams may have limited knowledge of the work location and may be unfamiliar with rapid excavation techniques, which can result in missed mining opportunities and damage to existing infrastructure, such as underground cabling, sewage lines, etc. Rapid excavation machines and techniques known in the art such as excavators or tunnel borers can lack the precision for fine excavation, especially excavation near utilities and delicate obstacles. As a result, some mining operations and projects may resort to manual digging to expose the utilities and obstacles to minimize damage while preparing the site.

Fine excavation techniques known in the art include manual digging with shovels or crude tools, such as compressed air or water machines. These techniques all have drawbacks. For example, workers can manually dig, but the process is slow and physically demanding. Workers can use compressed air around soft soils, but not to excavate hard soils and rocks. Further, workers can use water excavation techniques, but a large supply of water is needed. However, water is often unavailable and water excavation may not be permissible within the environment and may introduce hazards from flooding and water damage.

SUMMARY

The inventive apparatus, concepts, and techniques described herein are directed toward a grinder bit including a drum that is coupled to motorized shaft of a power tool, grinders for grinding and cutting materials, and cleats for further grinding and removing ground material. The grinders and cleats may be disposed along the outer surface of the drum, and rotated about the longitudinal axis of the drum in contact with a material, such as earth.

The grinder bit is scalable, i.e. it can be made larger or smaller to suit the needs of a particular application or environment. Further, the grinders and cleats may take on various shapes depending on the material to be excavated. The grinders and cleats may be arranged in various patterns, such as winding helical patterns offset from each other to grind and then remove the ground material as the drum rotates.

In one aspect of the invention, an apparatus for grinding material includes a grinder bit including a drum, grinders, and cleats. At least a portion of the grinders are disposed longitudinally in a first helical pattern along the outer surface of the drum, and at least a portion of the cleats are disposed longitudinally in a second helical pattern along the outer surface of the drum. The second helical pattern is offset from the first helical pattern. In further embodiments, the grinders and cleats may be disposed in other ways on the outer surface of the drum, for example, in rows and columns, or in blocks.

In further embodiments, the apparatus can include one or more of the following features: at least a portion of the drum is cylindrical and rotatably driven along the longitudinal axis of the drum; at least a portion of the drum is conical and rotatably driven along the longitudinal axis of the drum; at least one of the grinders extends a first length from the outer surface of the drum and at least one of the cleats extends a second length from the outer surface of the drum, the first length being longer than the second length.

In still further embodiments, at least one cleat includes a first surface and a second surface opposed to the first surface. The first and second surfaces are interchangeable such that one of the first and second surfaces forms a leading portion of at least one cleat based on a direction of rotation of the drum, and the other one of first and second surfaces forms a trailing portion of the at least one cleat. The cleat may further include a third surface adjacent and substantially perpendicular to the first and second surfaces, and a fourth surface adjacent and substantially perpendicular to the first and second surfaces and opposed to the third surface. At least one of the first and second surfaces further includes a first removal surface angled from the third surface and forming a first removal edge with the third surface, and a second removal surface coupled to the first removal surface, angled from the fourth surface, and forming a second removal edge with the fourth surface. The third and fourth surfaces are interchangeable such that one of the third and fourth surfaces is closer to the outer surface of the drum than the other one of the third and fourth surfaces. In yet another embodiment, the first removal surface and third surface form about a 60 degree angle at the first removal edge, and the second removal surface and fourth surface form about a 60 degree angle at the second removal edge. In still yet another embodiment, the cleat has a trapezoidal shape when viewed from an angle perpendicular to the outer surface of the drum and includes a leading surface formed between a first lateral surface of the cleat and a second lateral surface of the cleat opposing the first lateral surface, wherein the first and second lateral surfaces have different lengths. In another embodiment, the cleat includes a first cleat edge substantially perpendicular to the outer surface of the drum and formed by a first removal surface and a second removal surface coupled to the first removal surface, wherein the first removal surface is further coupled to a first lateral side of the cleat on a side opposing the second removal surface, and the second removal surface is further coupled to a second lateral side of the cleat on a side opposing the first removal surface.

In further embodiments, the apparatus can include one or more of the following features: at least one of the first and second helical patterns winds around the drum in a clockwise direction with respect to a first end of the drum coupled to a rotating shaft; at least one of the first and second helical patterns winds around the drum in a counter-clockwise direction with respect to a first end of the drum coupled to a rotating shaft; at least one of the first and second helical patterns includes a first helical pattern portion and a second helical pattern portion, wherein the first helical pattern portion winds around the drum in a clockwise direction with respect to a first end of the drum coupled to a rotating shaft and the second helical pattern portion winds around the drum in counter-clockwise direction with respect the first end of the drum; the first helical pattern portion is disposed closer to the first end of the drum than the second helical pattern portion; the second helical pattern portion is disposed closer to the first end of the drum than the first helical pattern portion; the first and second helical pattern portions are coupled at a point along the outer surface of the drum.

In a further embodiment, at least one first cleat has a first longitudinal radius equal to half the longitudinal diameter of the at least one first cleat, and at least one second cleat has a second longitudinal radius equal to half the longitudinal diameter of the at least one second cleat, wherein the at least one first cleat and the at least one second cleat are longitudinally disposed from each other on the outer surface of the drum a distance equal to the sum of the first longitudinal radius and the second longitudinal radius. In further embodiments, the first and second longitudinal radii are equal or, alternatively, the first and second longitudinal radii are unequal.

In further embodiments, the apparatus can include one or more of the following features: an adapter coupled to an end of the drum to secure the drum to a rotating shaft driven by a motor; the adapter is keyed, pinned, or threaded to the rotating shaft; a drum wall is defined by the outer surface of the drum and an inner surface of the drum axially opposing the outer surface of the drum, further including lumens extending through at least a portion of the drum wall, the lumens to secure at least a portion of the grinders and at least a portion of the cleats to the drum; longitudinal grooves formed along the inner surface of the drum wall define inner surface ridges, wherein the lumens extend through at least a portion of the inner surface ridges.

BRIEF DESCRIPTION OF THE DRAWINGS

The foregoing features of the inventive apparatus, techniques, and concepts may be more fully understood from the following description of the drawings in which.

DETAILED DESCRIPTION

Figure 1:
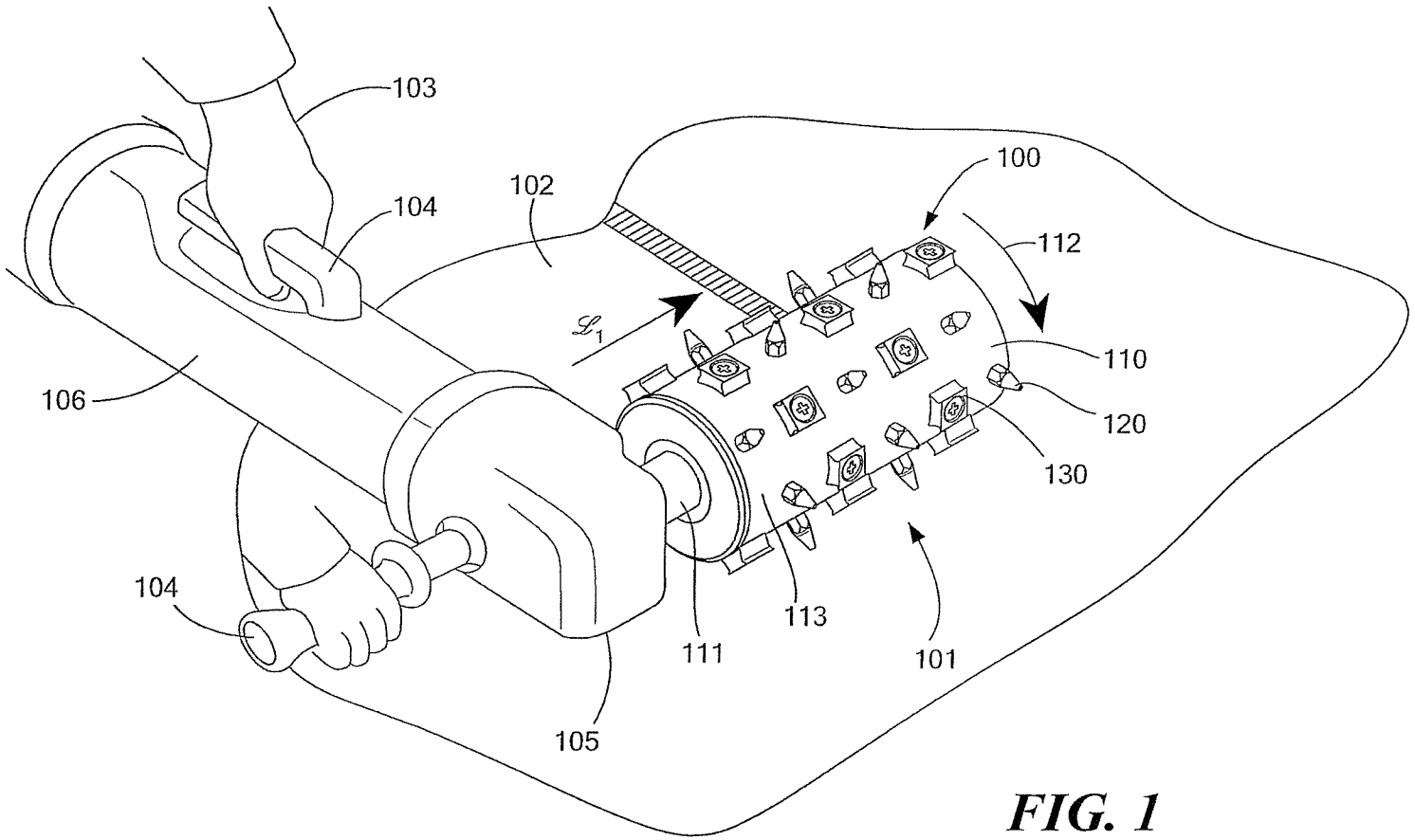
FIG. 1 is a pictorial representation of an environment including an operator using a tool coupled to a grinder bit for grinding material, the grinder bit in accordance with an exemplary embodiment of the inventive apparatus, concepts, and techniques described herein.

FIG. 1 shows an exemplary embodiment of an inventive apparatus including a grinder bit 100 for grinding and removing a material 101 from a surface 102. An exemplary application of the grinder bit 100 may include excavating and removing earth material from surface areas adjacent to a foundation so that objects such as underground piping and/or wiring may be installed within the ground surface areas. Another exemplary application of the grinder bit may include constructing a grade or mound surrounded by a generally flat area, such as a pitcher's mound of a baseball field. Still another exemplary application of the grinder bit may include sculpting an object, such as a piece of stone.

The grinder bit 100 includes a drum 110 coupled to a motorized shaft 111 or power hand tool 106 controlled by an operator 103. The power hand tool 106 may include handles 104, which aide the operator 103 in holding the grinder bit 100 and drum 110 in a desired position for grinding. The motorized shaft 111 may be connected to a motor 105 housed in the tool 106 in order to operate the drum 110. For example, the motorized shaft 111 may operate the drum 110 in a rotation direction 112 perpendicular to a longitudinal axis $L_1$ of the drum 110.

The rotational speed of the grinder bit 100 is generally determined by the size of the tool 106, the motor 105, and other design aspects of the grinder bit 100, such as size and weight. For small hand-power tools, the rotational speed may be relatively high to minimize stalling of the grinder bit 100. For heavy duty applications, a larger tool with a larger motor providing more torque may be used at lower rotational speeds, which may extend the life of the grinder bit 100 (and tool).

The drum 110 includes an outer surface 113 to hold grinders 120 and cleats 130. The grinders 120 and cleats 130 are held in place such that the operation of the drum 110 causes the grinders 120 to grind away at the material 101 and the cleats 130 to remove the ground material. More particularly, the grinders 120 and cleats 130 may be disposed in helical patterns along the outer drum surface 113. As will be further described, the helical patterns wind around the outer surface of the drum 113 and are generally offset from each other. In this way, the grinders 120 rotate along with the drum 110 and grind the surface at a location adjacent to the outer drum surface 113. The cleats 130 also rotate along with the drum 110 behind the grinders 120 to remove the ground material. For example, the cleats 130 may collect the ground material at an area behind the drum 110 while the operator 103 advances the grinder bit 100 so that the grinders 120 may continue to grind away at an unobstructed surface area. It will be understood, however, that the grinders 120 and the cleats 130 are not limited to respective grinding and removing of the material. For example, the grinders 120 may further remove the material, and the cleats 130 may further grind the material.

Figure 2:
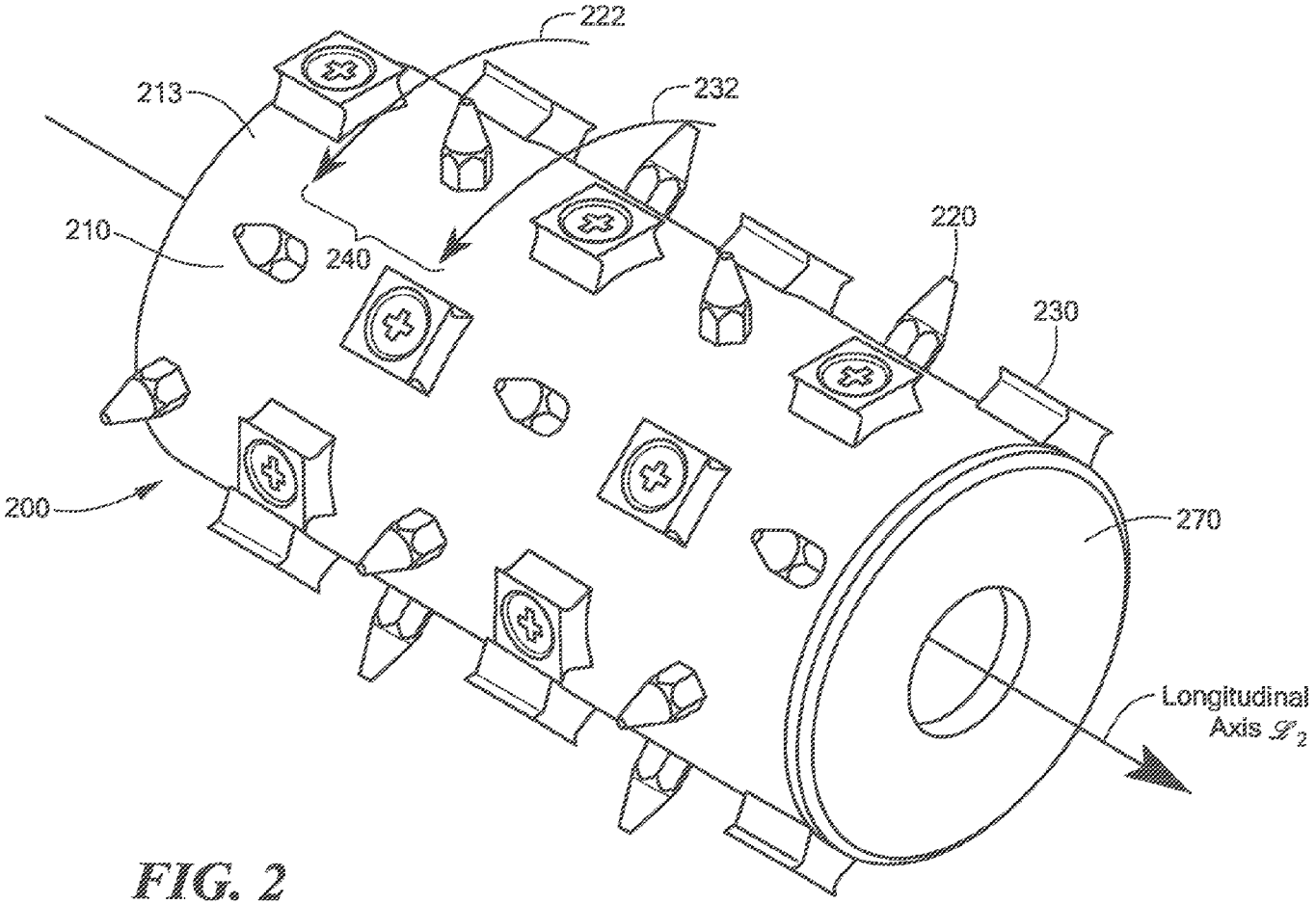
FIG. 2 is a close-up pictorial view of the grinder bit of FIG. 1.

Referring now to FIG. 2, an embodiment of an inventive apparatus for grinding material includes a grinder bit 200 including a drum 210, grinders 220 to grind a material, and cleats 230 to remove the ground material. The grinders 220 and cleats 230 are disposed on at least a portion of the outer drum surface 213 along a longitudinal axis $L_2$ substantially coincident with the axial center of the drum 210.

In the embodiment of the inventive apparatus shown in FIG. 2, the grinders 220 are disposed on the outer drum surface 213 along a first helical pattern 222 that winds about the outer drum surface 213. The cleats 230 are disposed along a second helical pattern 223 that also winds about the outer drum surface 213, however, offset 240 from the first helical pattern 222. The grinder bit 200 may further include an adapter 270, to be described in more detail below.

It will be understood that the inventive apparatus is not limited to the grinders and cleats disposed in helical patterns along an outer surface of the drum. For example, the grinders may be disposed in longitudinal rows along an outer surface of the drum. The rows of grinders may be interspersed with rows of cleats. Alternatively, each row may be interspersed with grinders and cleats. Further, the grinders and/or cleats may not extend along the entire portion of a drum. In this way, the grinding area of the grinder bit can be shortened. This may be useful for making one or more grooves in a material or ground portions in a material.

As will be further described below, grinders and cleats may be secured to an outer surface of the drum in a number of ways. For example, grinders and/or cleats may be threaded to enable screwing of the grinders and/or cleats into threaded holes in a drum wall. In this way, the grinders and/or cleats can be easily removed for maintenance and replacement. In other non-limiting embodiments, grinders and/or cleats may be welded to an outer surface of a drum, or pounded into holes in a drum wall using a mallet.

Referring again to FIG. 2, the grinder bit 200 may be comprised of metal and/or non-metal materials. For example, the grinder bit 200 may be made of aluminum or steel to provide strength and durability, especially useful in grounding hard materials such as rocky earth and concrete. In other embodiments, the grinder bit 200 may be made of plastic and/or rubber. Rubber may be used to minimize the removal of soft outer sheaths of electric wire which may come in contact with the grinder bit 200.

Figure 3:
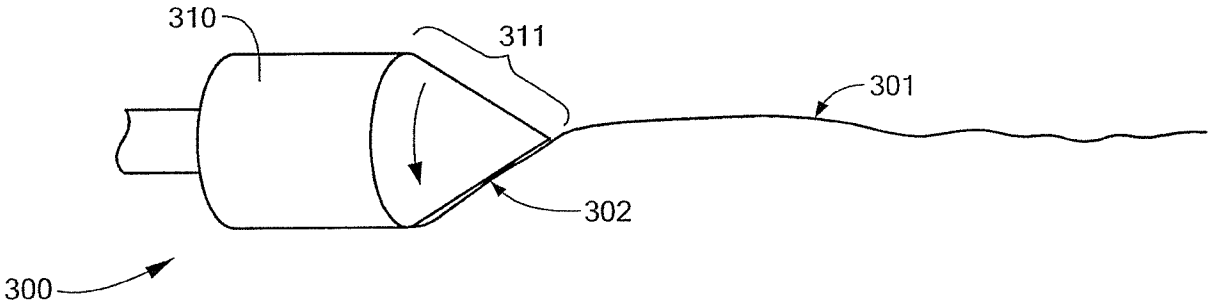
FIG. 3 is a pictorial representation of a cone-shaped grinder bit in accordance with an exemplary embodiment of the inventive apparatus, concepts, and techniques described herein.

The grinder bit 200 includes a drum 210, at least a portion of which is cylindrical. However, it will be understood that the drum 210 may be configured as other shapes and/or combinations of shapes. For example, in another embodiment of the apparatus shown in FIG. 3, a cone-shaped grinder bit 300 includes a drum 310, at least a portion of which is cone-shaped 311. In this way, the operator may hold the grinder bit 300 generally level with a material 301 to create a graded portion of the ground surface 302. For example, the operator may use the cone-shaped configuration to create a graded pitcher's mound.

Figure 4:
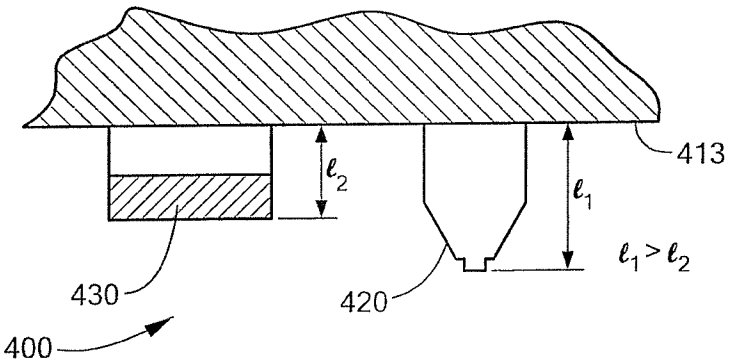
FIG. 4 is a pictorial representation of grinders and cleats in accordance with an exemplary embodiment of the inventive apparatus, concepts, and techniques described herein.

In a further embodiment of the inventive apparatus shown in FIG. 4, a grinder bit 400 includes grinders 420 extending a first length $l_1$ from the outer surface of the drum 413 and cleats 430 extending a second length $l_2$ from the outer surface of the drum 413. The first length $l_1$ is greater than the second length $l_2$. In this way, the grinders 420 are configured to grind away at a material at a greater depth than the extended cleats 430 so that the cleats can remove ground material.

Figure 5:
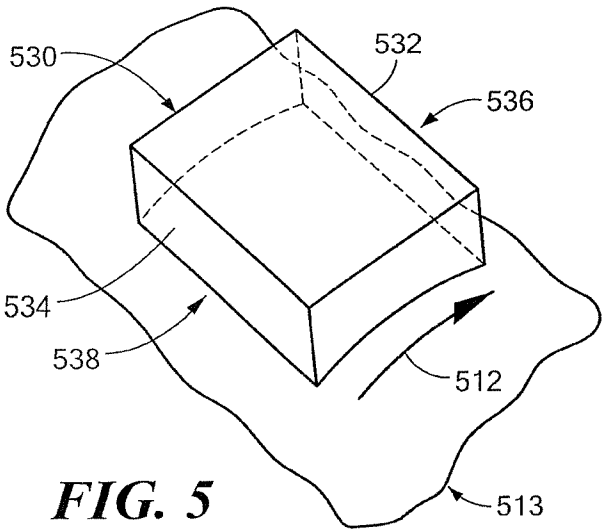
FIG. 5 is a pictorial representation of a cleat in accordance with an exemplary embodiment of the inventive apparatus, concepts, and techniques described herein.

In a further embodiment of the inventive apparatus shown in FIG. 5, a cleat 530 includes a first surface 532 and a second surface 534. The cleat 530 is disposed on the outer surface of a drum 513 and is rotated in a direction 512. In this way, the cleat 530 can be said to have a leading portion 536 and a trailing portion 538. For example, the cleat 530 may be disposed such that the first surface 532 forms the leading portion 536 of the cleat 530 and the second surface 534 forms the trailing portion 538 of the cleat 530, such that the first surface 532 operates to remove ground material. However, the first and second surfaces 532, 534 may be interchanged by repositioning the cleat 530 so that the second surface 534 forms the leading portion 536 of the cleat 530 and the first surface forms the trailing portion 538 of the cleat 530. Such interchangeability of the first and second surfaces 532, 534 permits the cleat 530 to be repositioned when one of the first and second surfaces 532, 534 becomes worn due to grinding and removal operation.

Figure 6A:
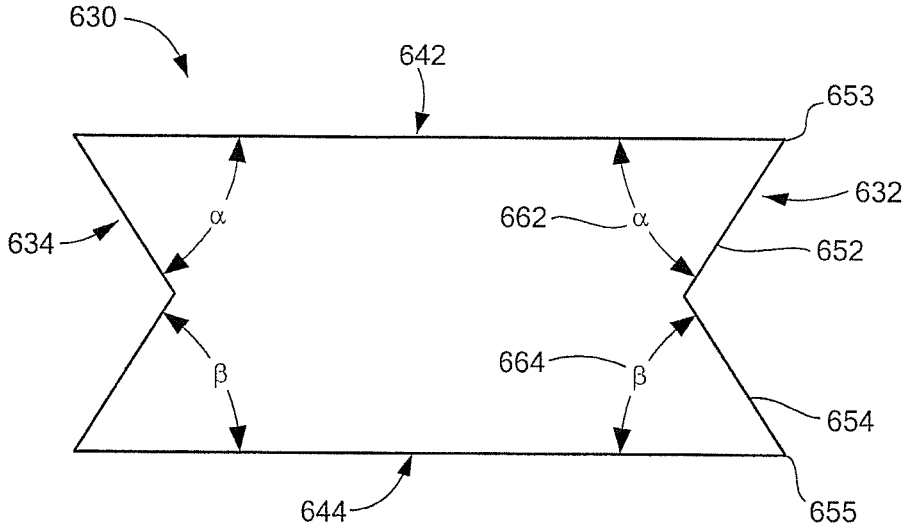
FIG. 6A is a side-view pictorial representation of a cleat in accordance with another exemplary embodiment of the inventive apparatus, concepts, and techniques described herein.
Figure 6B:
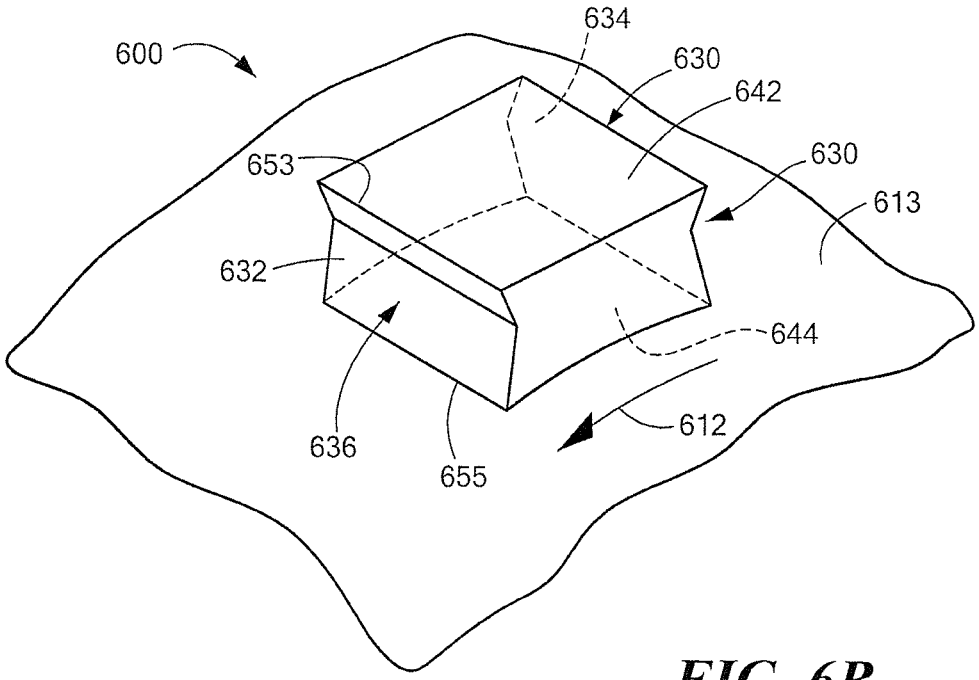
FIG. 6B is a perspective view of the cleat of FIG. 6A.

In still a further embodiment of the inventive apparatus shown in FIGS. 6A and 6B, a grinder bit 600 includes a cleat 630 further including a third surface 642 adjacent and substantially perpendicular to a first surface 632 and a second surface 634 of the cleat 630. The cleat 630 also includes a fourth surface 644 adjacent and substantially perpendicular to the first surface 632 and the second surface 634 and opposed to the third surface 642.

The first surface 632 further includes a first removal surface 652 and a second removal surface 654. The first and second removal surfaces 652, 654 are coupled. The first removal surface 652 is angled from the third surface 642 to form a first removal edge 653 with the third surface 642. The second removal surface 654 is angled from the fourth surface 644 to form a second removal edge 655 with the fourth surface 644. As shown in FIG. 6A, the first removal edge 653 forms a first angle $\alpha$ (designated by reference numeral 662) between coupled first removal surface 652 and third surface 642. Further, the second removal edge 655 forms a second angle $\beta$ (designated by reference numeral 664) between coupled second removal surface 654 and fourth surface 644. In still a further embodiment of the cleat 630, the first angle $\alpha$ is approximately equal to 60 degrees, and the second angle $\beta$ is also approximately equal to 60 degrees.

As shown in FIG. 6B, the third and fourth surfaces 642, 644 of the cleat 630 are interchangeable such that one of the third and fourth surfaces 642, 644 is disposed closer to the outer surface of the drum 613. The cleat 630 may move in a direction of rotation 612 such that one of the first and second surfaces 632, 634 forms a leading portion of the cleat 636 and the other one of the first and second surfaces 632, 634 forms a trailing portion of the cleat 638. For example, FIG. 6B shows the first surface 632 forming the leading portion of the cleat 630. Further, one of the first and second removal edges 653, 655 forms an outer edge of the cleat 630 to perform removal of ground material. As shown in FIG. 6B, the first removal edge 653 forms the outer edge of the cleat 630, however, the third and fourth surfaces may be interchanged such that the second removal edge 655 forms the outer edge of the cleat 630. For example, when the first removal edge 653 becomes worn, it may be interchanged with the second removal edge 655. In still another embodiment, the first and second surfaces 632, 634 may be interchanged to provide two further removal edges. Thus, the cleat 630 may include at least four removal edges to extend the cleat's operational life. It will be understood, however, that the cleat 630 is not limited to four removal edges and may include any number of removal edges.

Figure 7A:
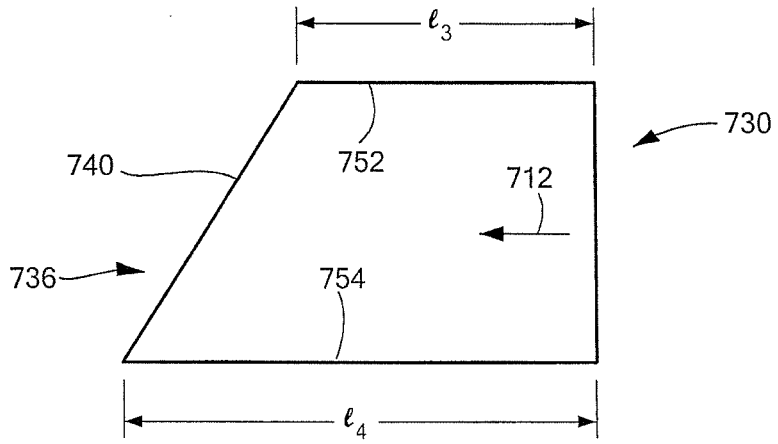
FIG. 7A is a top view pictorial representation of a trapezoidal-shaped cleat in accordance with another exemplary embodiment of the inventive apparatus, concepts, and techniques described herein.

In a further embodiment of the inventive apparatus shown in FIG. 7A, a grinder bit includes a cleat 730 having a trapezoidal shape when viewed from an angle perpendicular to the outer surface of the drum. The cleat 730 includes a leading surface 740 formed between a first lateral surface 752 of the cleat 730 and a second lateral surface 754 of the cleat 730 opposing the first lateral surface 752. The first lateral surface has length $l_3$ and the second lateral surface has length $l_4$, which is different than $l_3$. The leading surface 740 defines a leading portion 736 of the cleat 730 based on a rotation direction 712 of the cleat 730.

Figure 7B:
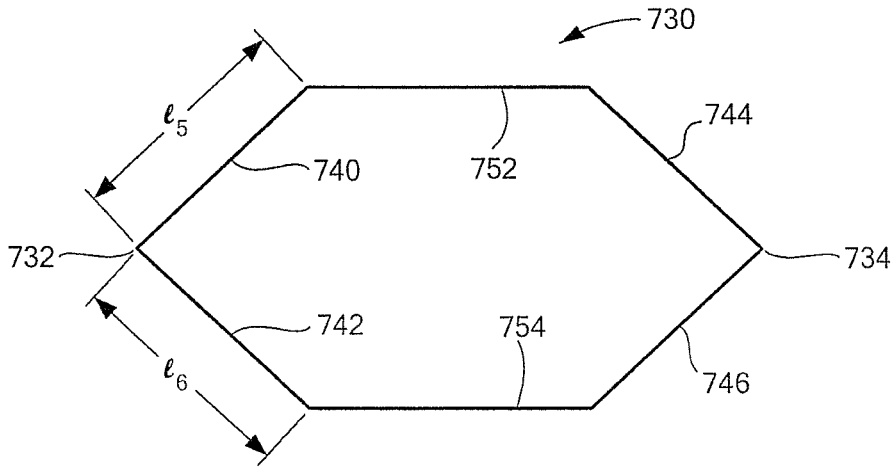
FIG. 7B is a top view pictorial representation of an edged cleat in accordance with another exemplary embodiment of the inventive apparatus, concepts, and techniques described herein.

In a further embodiment of the inventive apparatus shown in FIG. 7B, a grinder bit includes a cleat 730 including a first cleat edge 732 substantially perpendicular to the outer surface of the drum and formed by a first removal surface 740 and a second removal surface 742 coupled to the first removal surface 740. The first removal surface 740 is further coupled to a first lateral side 752 of the cleat 730 on a side opposing the second removal surface 742. Further, the second removal surface 742 is further coupled to a second lateral side 754 of the cleat 730 on a side opposing the first removal surface 740. In still a further embodiment, the cleat 730 further includes a second removal edge 734 opposing the first removal edge 732, and formed between a third removal surface 744 and a fourth removal surface 746 coupled to the third removal surface 744.

Referring again to FIG. 7B, the first removal surface has a length $l_5$ and the second removal surface has a length $l_6$. In still a further embodiment of the cleat 730, lengths $l_5$ and $l_6$ are equal, and cleat 730 is longitudinally symmetric. In this configuration, the removal surfaces 740, 742 tend to remove substantially equal amounts of material to either lateral side of the cleat 730. Alternatively, lengths $l_5$ and $l_6$ are unequal, and cleat 730 is longitudinally skewed. In this configuration, the removal surface having the longer length will tend to remove more material toward the side of the cleat 730 coupled to the longer removal surface.

Figure 8A:
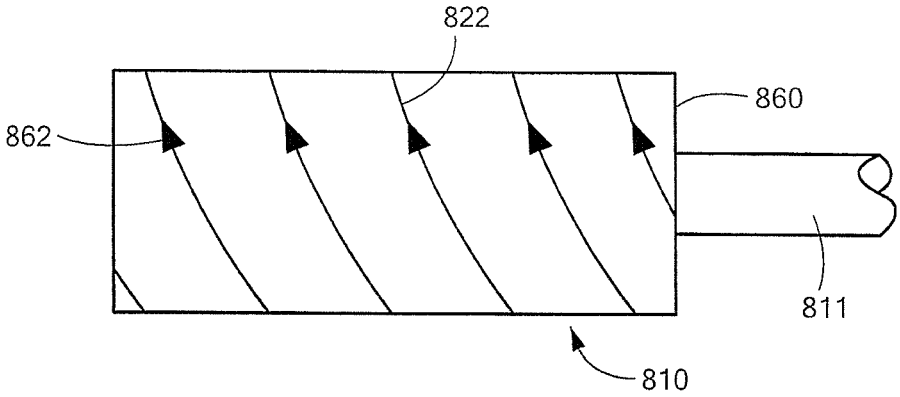
FIG. 8A is a pictorial representation of a helical pattern in accordance with an exemplary embodiment of the inventive apparatus, concepts, and techniques described herein.
Figure 8B:
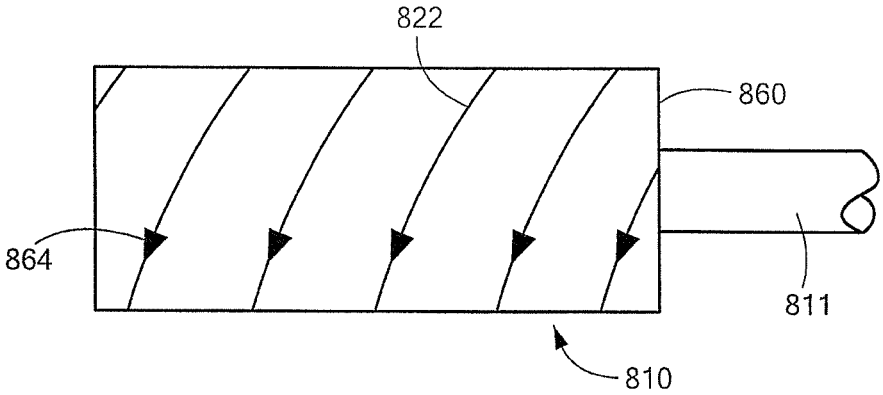
FIG. 8B is a pictorial representation of a helical pattern in accordance with another exemplary embodiment of the inventive apparatus, concepts, and techniques described herein.

In a further embodiment of the inventive apparatus shown in FIG. 8A, at least one of a first helical pattern 822 and a second helical pattern may wind around a drum 810 in a clockwise direction 862 with respect to an end of the drum 860 coupled to a rotating shaft 811. In yet another embodiment of the inventive apparatus shown in FIG. 8B, in which like elements of FIG. 8A are provided having like reference designations, at least one of a first helical pattern 822 and a second helical pattern may wind around a drum 810 in a counter-clockwise direction 864 with respect to an end of the drum 860 coupled to a rotating shaft 811.

Figure 9A:
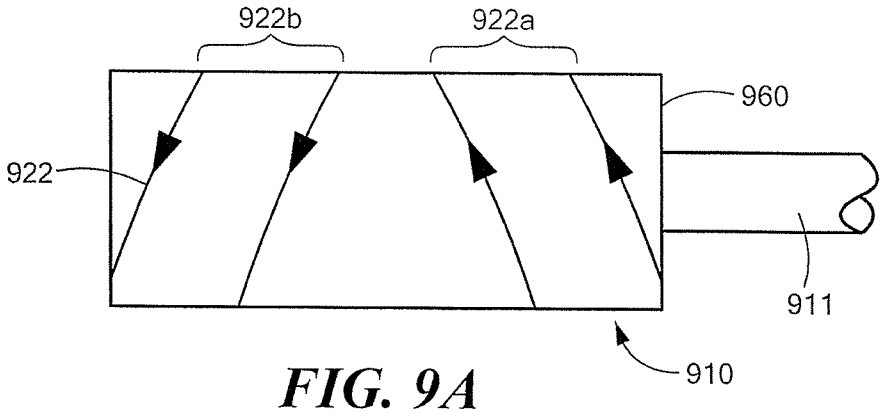
FIG. 9A is a pictorial representation of a first helical pattern portion and a second helical pattern portion in accordance with an exemplary embodiment of the inventive apparatus, concepts, and techniques described herein.

It will be understood that the first and second helical patterns may wind around the drum in various combinations of clockwise and counter-clockwise directions, along various portions of the drum. Further, the helical patterns may be coupled to each other at various locations of the drum, for example, at the longitudinal center of the drum. In a further embodiment of the inventive apparatus shown in FIG. 9A, at least one of a first helical pattern and a second helical pattern includes a first helical pattern portion and a second helical pattern portion. For example, FIG. 9A shows a first helical pattern 922 including a first helical pattern portion 922*a* and a second helical pattern portion 922*b* disposed along different lengths of the drum 910. In FIG. 9A, the first helical pattern portion may wind around the drum 910 in a clockwise direction with respect to a first end of the drum 960 coupled to a rotating shaft 911, and the second helical pattern portion 922*b* may wind around the drum 910 in a counter-clockwise direction with respect to the first end of the drum 960. In the exemplary embodiment shown in FIG. 9A, the first helical pattern portion 922*a* is disposed closer to the first end of the drum 960 than the second helical pattern portion 922*b*. However, as shown in FIG. 9B, in which like elements of FIG. 9A have like reference designations, in yet another embodiment of the inventive apparatus, the second helical pattern portion 922*b* is disposed closer to the first end of the drum 960 than the first helical pattern portion 922*a*.

Figure 9B:
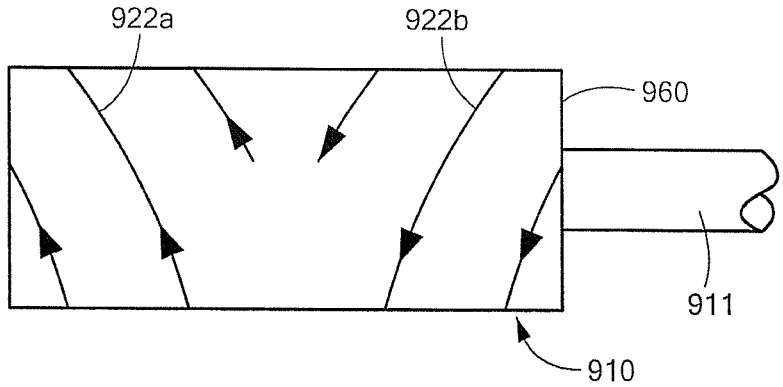
FIG. 9B is a pictorial representation of a second helical pattern portion in accordance with another exemplary embodiment of the inventive apparatus, concepts, and techniques described herein.
Figure 9C:
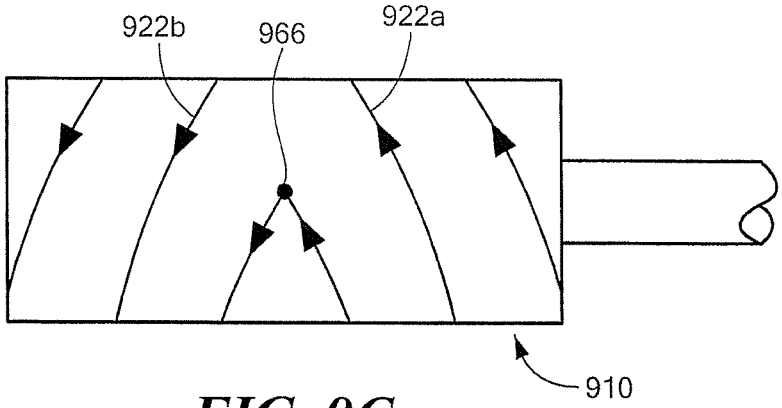
FIG. 9C is a pictorial representation of a first helical pattern portion and a second helical pattern portion in accordance with still another exemplary embodiment of the inventive apparatus, concepts, and techniques described herein.

Further, in FIG. 9B, the first and second helical pattern portions 922*a*, 922*b* are not coupled to each other. However, it will be understood that the first and second helical pattern portions 922*a*, 922*b* may be coupled. For example, as shown in FIG. 9C, in which like elements of FIG. 9B have like reference designations, in still a further embodiment of the inventive apparatus, the first helical pattern portion 922*a* is coupled to the second helical pattern portion 922*b* at point P 966. Point P 966 is shown to be substantially coincident with the longitudinal center point of the drum 910, however, it will be understood that point P 966 may be occur at any point along the drum 910 in order to control movement and collection of ground material. For example, in the configuration of the inventive apparatus shown in FIG. 9C, cleats will tend to move and collect the ground material toward an area adjacent to the longitudinal center area of the drum 910 when the drum 910 is rotated.

Figure 10A:
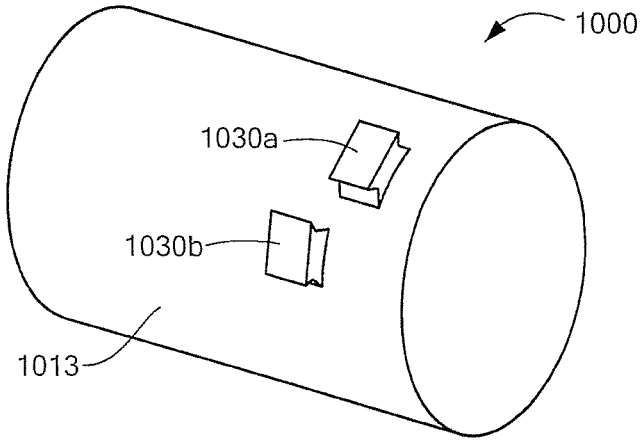
FIG. 10A is a perspective view pictorial representation of cleats disposed longitudinally along the outer surface of the drum in accordance with an exemplary embodiment of the inventive apparatus, concepts, and techniques described herein.
Figure 10B:
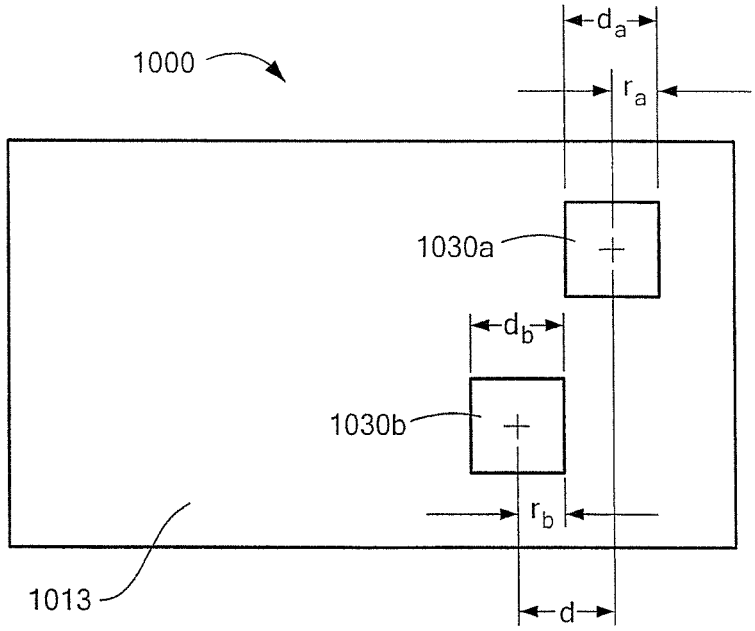
FIG. 10B is a side view pictorial representation of the cleat shown in FIG. 10A.

In a further embodiment of the inventive apparatus shown in FIGS. 10A and 10B, at least one first cleat 1030*a* has a first longitudinal radius $r_a$ equal to half the longitudinal diameter $d_a$ of the at least one first cleat 1030*a*, and at least one second cleat 1030*b* has a second longitudinal radius $r_b$ equal to half the longitudinal diameter $d_b$ of the at least one second cleat 1030*b* The first cleat 1030*a* and the second cleat 1030*b* are longitudinally disposed from each other on the outer surface of the drum 1013 a distance d equal to the sum of the first longitudinal radius $r_a$ and the second longitudinal radius $r_b$. In this way, longitudinal portions of ground material may be removed one after another as first and second cleats 1030*a*, 1030*b* rotate about the grinder bit 1000. A plurality of cleats arranged in this way can remove ground material along the entire longitudinal length of the grinder bit 1000 from a cleat disposed on one side of the grinder bit 1000 to another cleat disposed on the opposing side of the grinder bit 1000. In still a further embodiment, the first and second longitudinal radii $r_a$ and $r_b$ are equal. This configuration accommodates a set of cleats having the same diameters. In yet another embodiment, the first and second longitudinal radii $r_a$ and $r_b$ are unequal. This configuration accommodates differently sized cleats.

Figure 11:
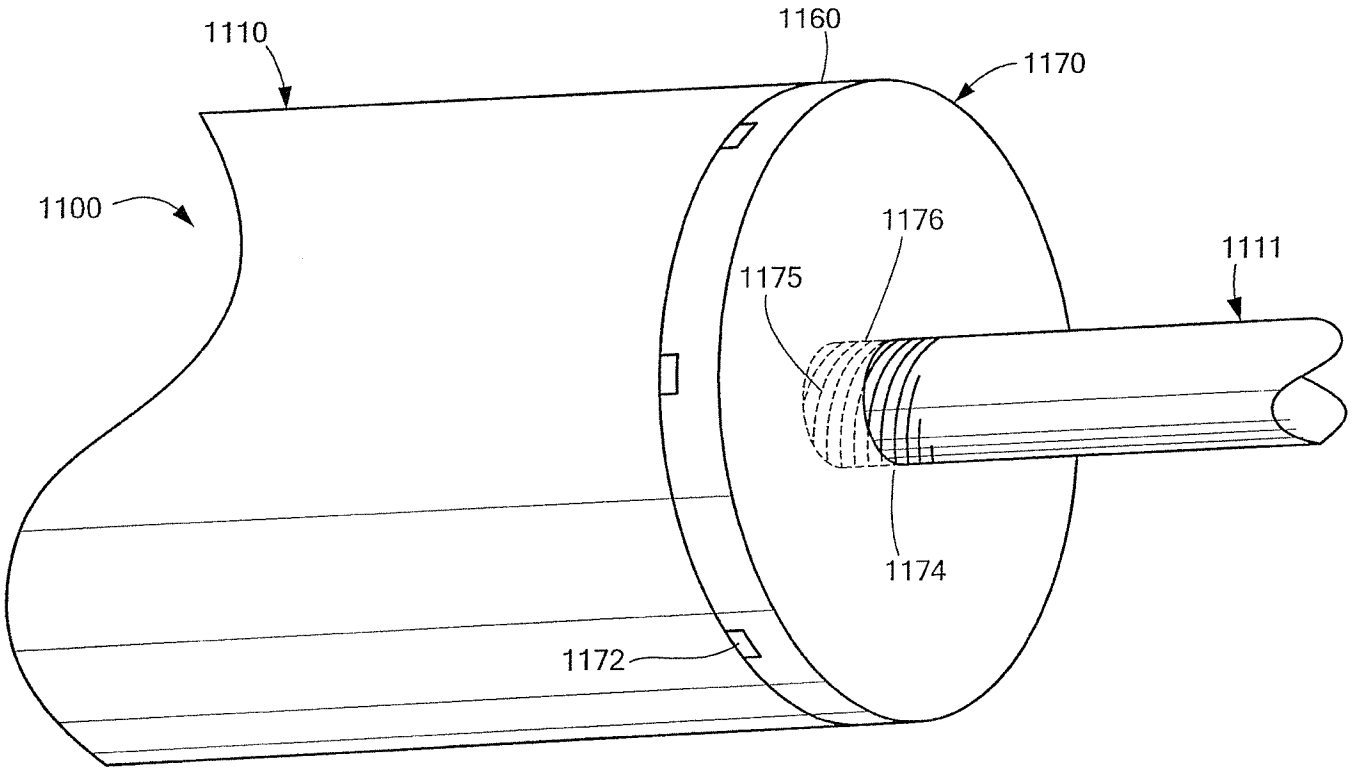
FIG. 11 is a pictorial representation of an adapter in accordance with an exemplary embodiment of the inventive apparatus, concepts, and techniques described herein.

In another embodiment of the inventive apparatus described herein shown in FIG. 11, a grinder bit apparatus 1100 further includes an adapter 1170 coupled to an end of the drum 1160 to secure the drum 1110 to a rotating shaft 1111. The rotating shaft 1111 may be driven by a motor. The adapter 1170 may be coupled to the end of the drum 1160 in a variety of ways. For example, as shown in FIG. 11, the adapter 1170 may be welded to the drum 1110 via one or more welds 1172.

Although the inventive apparatus is not limited to any the following, the adapter 1170 may be screwed to the drum 1110 using screws, secured using epoxy, and/or riveted using rivets.

Referring again to FIG. 11, the adapter 1170 may be secured to the rotating shaft 1111 using a variety of methods. Although the inventive apparatus is not limited to any of the following, the adapter 1170 may be keyed, pinned, or threaded to the rotating shaft 1111. For example, the adapter 1170 may be threaded to the rotating shaft 1111 using adapter threads 1174 along an inner lumen 1175 formed through the axial center of the adapter 1170 and threaded to thread grooves 1176 along the outside surface of the rotating shaft 1111.

Figure 12A:
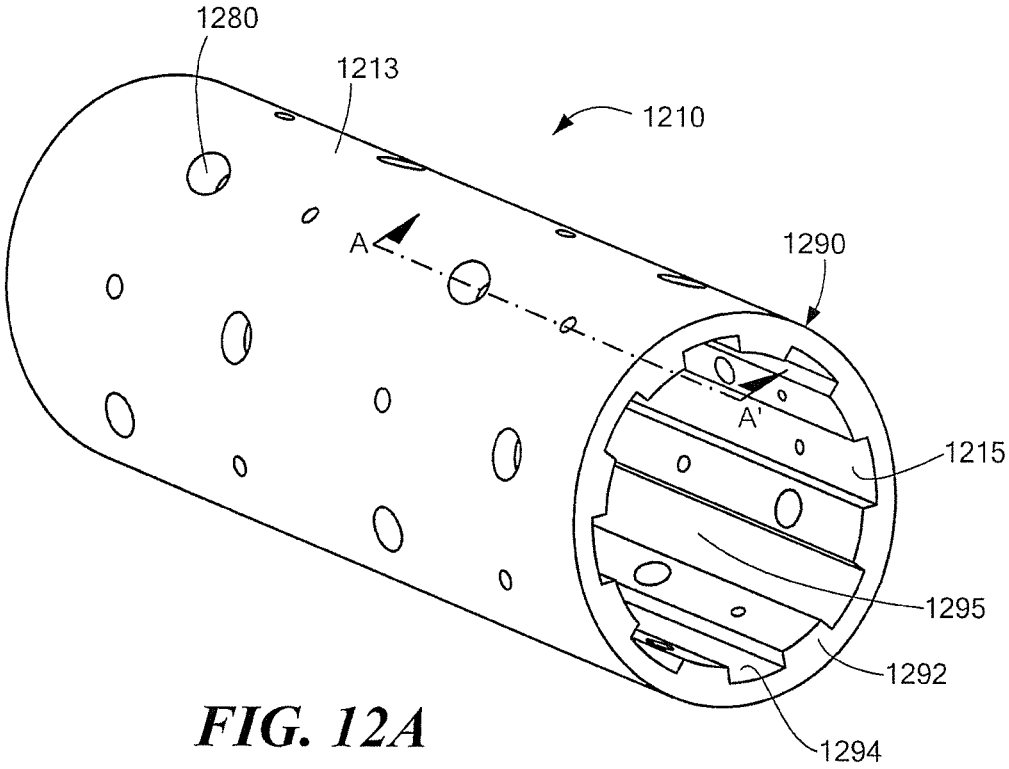
FIG. 12A is a pictorial representation of a drum, including lumens and ridges in accordance with an exemplary embodiment of the inventive apparatus, concepts, and techniques described herein.

In another embodiment of the inventive apparatus shown in FIG. 12A, a drum 1210 includes a drum wall 1290 defined by an outer surface of the drum 1213 and an inner surface of the drum 1215 axially opposing the outer surface of the drum 1213. The resulting drum 1210 is substantially hollow 1295 to reduce its overall weight and improve performance. The drum wall 1290 includes lumens 1280 to secure at least a portion of the grinders and at least a portion of the cleats to the drum 1210. To better illustrate the exemplary lumens 1280 in FIG. 12A, grinders and cleats are not shown.

Figure 12B:
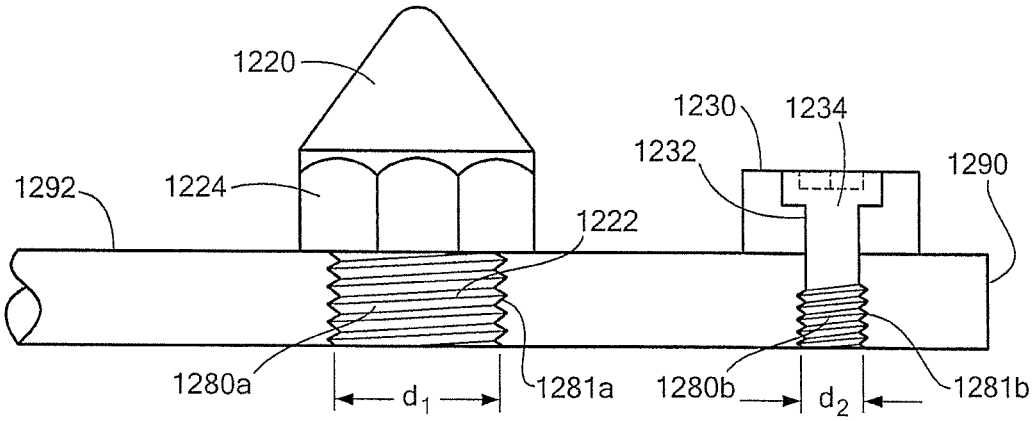
FIG. 12B is a cross-sectional pictorial representation of the drum in FIG. 10A taken along line AA'.

The grinders and cleats may be secured to the drum wall in any number of ways, including those described above. For example, FIG. 12B shows a cross-sectional view of a portion of the drum wall 1290 and lumens 1280 shown in FIG. 12A at reference line AA'. Here, an embodiment of the inventive apparatus is shown including grinder 1220 disposed in lumen 1280*a* and cleat 1230 disposed in lumen 1280*b*. Grinder 1220 is secured to the drum wall 1290 via lumen 1280*a* by screwing a threaded base portion of the grinder 1222 into thread grooves 1281*a* in the lumen wall. A wrench may be used on a nut portion 1224 of the grinder 1220 to screw and tighten the grinder 1220 in the lumen 1280*a*. Further, cleat 1230 is secured to the drum wall 1290 via lumen 1280*b* by inserting a threaded screw 1234 through a hollowed-out portion of the cleat 1232, and by screwing the threaded screw 1234 into thread grooves 1281*b* in the lumen wall.

In an embodiment of the inventive apparatus, lumens 1280*a* and 1280*b* have different diameters to accommodate and secure various sizes and types of grinders 1220 and cleats 1230. In particular, when grinders 1220 are designed to be larger than cleats 1230, a diameter $d_1$ of lumens 1280*a* may be greater than a diameter $d_2$ of lumens 1280*b*.

Referring again to FIG. 12A, in still a further embodiment of the inventive apparatus, longitudinal grooves 1294 are formed along the inner surface of the drum wall 1215 to define inner surface ridges 1292. The lumens 1280 extend through at least a portion of the inner surface ridges 1292. For example, lumens 1280 in FIG. 12A extend through the entire inner surface ridges 1292. The grooves 1294 reduce the weight of the drum 1210 while the ridges 1292 provide strength to secure the grinders 1220 and cleats 1230. It will be understood, however, that the grooves 1294 and the ridges 1292 need not necessarily be formed along the inner surface of the drum wall 1215. For example, the grooves 1294 and ridges 1292 may be formed on the outer surface of the drum wall 1213. Further, the grooves 1294 and ridges 1292 may be formed axially, instead of longitudinally. Still further, the grooves 1294 and ridges 1292 may follow the helical patterns described above.

Figure 13:
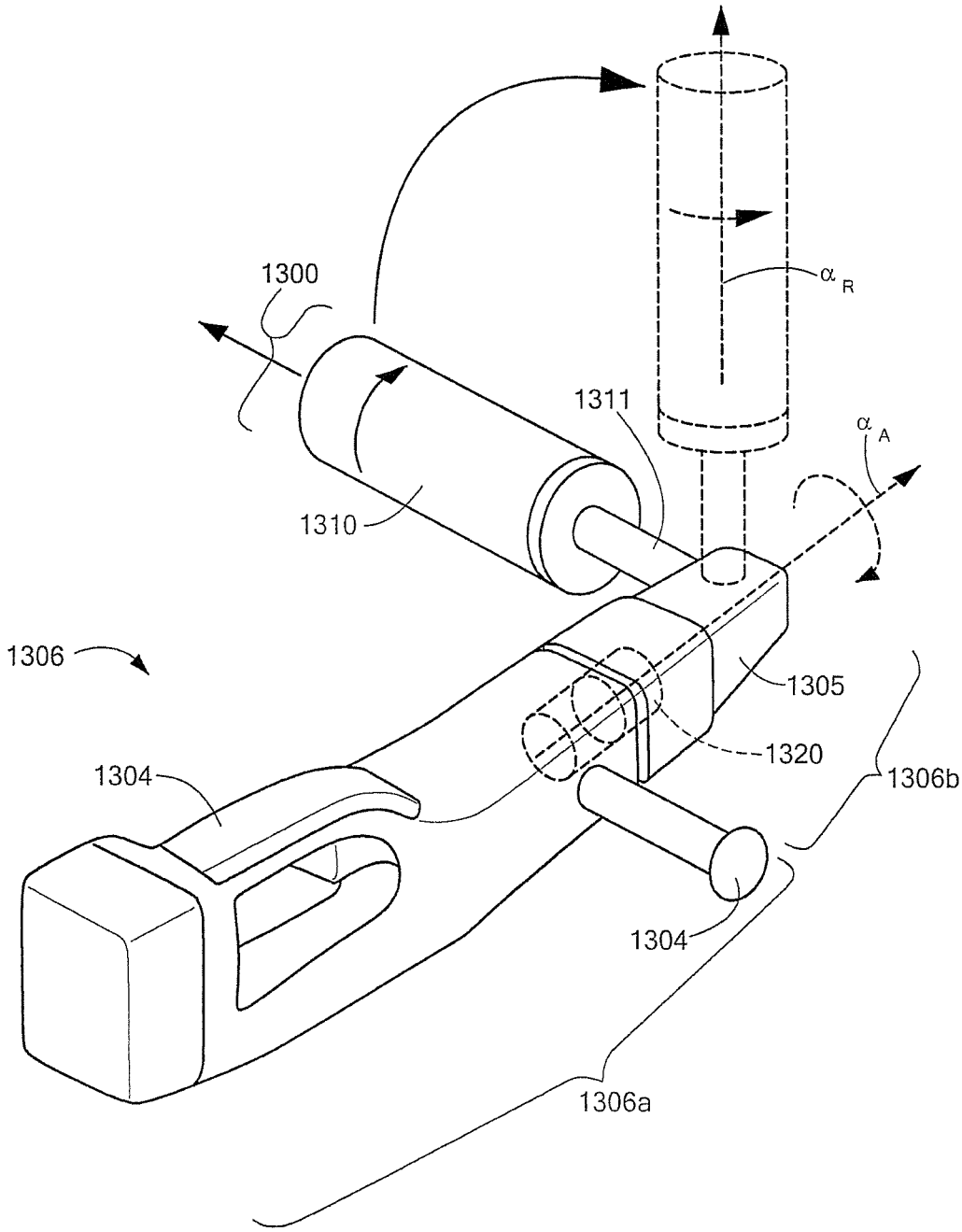
FIG. 13 is a pictorial representation of a drum including an adjusting portion in accordance with an exemplary embodiment of the inventive apparatus, concepts, and techniques described herein.

In another embodiment of the inventive apparatus shown in FIG. 13, a grinder bit 1300 is included in a tool 1306 having a stationary portion 1306 a and an adjusting portion 1306*b*. The stationary portion 1306*a* includes handles 1304, and the adjusting portion 1306*b* includes a motor 1305, a shaft 1311, and the grinder bit 1300. The drum 1310 of the grinder bit 1300 and shaft 1311 are driven along a rotational axis $\alpha_R$ by motor 1305, and may be further rotated along an adjustment axis $\alpha_A$ perpendicular to the rotational axis $\alpha_R$. In this way, the drum 1310 continues to rotate along rotational axis $\alpha_R$ as the entire adjusting portion 1306*b* is rotated along adjustment axis $\alpha_A$. This may be accomplished in any number of ways including, but not limited to, an adjuster 1320 which couples the stationary portion 1306*a* and the adjusting portion 1306*b* while allowing the adjusting portion 1306*b* to freely and independently rotate about the stationary portion 1306*a* of the tool 1306. For example, the adjuster 1320 may include a series of concentric shafts which rotate about each other and are locked in place using bits inserted axially through the shafts at predefined holes to align the shafts at various angles. In this way, an operator can produce a graded surface by rotating the adjusting portion at the desired grade while being able to hold the stationary portion level, providing increased flexibility, comfort, and control.

In a further embodiment of the inventive apparatus, concepts, and techniques described herein, the grinder bit may further include a screen secured to the tool. The screen is non-rotating and may arc around the grinder bit from an angle ranging from about 45 to 90 degrees. Further, the screen may be offset from the grinders ranging from about ¼-½ inch. The screen serves to protect the operator from stray material and may also contain the dispersal of ground material. The screen may be secured to the tool in any number of ways. For example, the screen may be secured to the end of the tool proximate to the grinder bit using a key, pin, or with threads.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. An apparatus for grinding material, comprising:

a grinder bit suitable for a power hand tool comprising:

a drum;

a plurality of grinders for grinding material, at least a portion of the grinders affixed longitudinally in a first helical pattern along the outer surface of the drum; and a plurality of cleats for removing the material ground by the grinders, at least a portion of the cleats at least partially box shaped and affixed longitudinally in a second helical pattern along the outer surface of the drum, at least a portion of the grinders along the first helical pattern is interdisposed with at least a portion of the cleats along the second helical pattern, wherein at least one cleat has a first surface and a second surface non-continuous from the first surface, at least a portion of the second surface substantially parallel to the first surface and opposed to the first surface, wherein the first surface and the second surface are interchangeable such that in a first state the first surface forms a leading portion of the at least one cleat and in a second state the second surface forms a leading portion of the at least one cleat.

2. The apparatus of claim 1, wherein at least a portion of the drum is cylindrical and rotatably driven along the longitudinal axis of the drum.

3. The apparatus of claim 1, wherein at least a portion of the drum is conical and rotatably driven along the longitudinal axis of the drum.

4. The apparatus of claim 1, wherein at least one of the grinders extends a first length from the outer surface of the drum and at least one of the cleats extends a second length from the outer surface of the drum, the first length being longer than the second length.

5. The apparatus of claim 1, wherein at least one of the first and second helical patterns winds around the drum in a clockwise direction with respect to a first end of the drum coupled to a rotating shaft.

6. The apparatus of claim 1, wherein at least one first cleat has a first longitudinal radius equal to half the longitudinal diameter of the at least one first cleat, and at least one second cleat has a second longitudinal radius equal to half the longitudinal diameter of the at least one second cleat, wherein the at least one first cleat and the at least one second cleat are longitudinally disposed from each other on the outer surface of the drum a distance equal to the sum of the first longitudinal radius and the second longitudinal radius.

7. The apparatus of claim 6, wherein the first and second longitudinal radii are equal.

8. The apparatus of claim 6, wherein the first and second longitudinal, radii are unequal.

9. The apparatus of claim 1, further comprising:

an adapter coupled to an end of the drum to secure the drum to a rotating shaft driven by a motor.

10. The apparatus of claim 9, wherein the adapter is keyed, pinned, or threaded to the rotating shaft.

11. The apparatus of claim 1, wherein a drum wall is defined by the outer surface of the drum and an inner surface of the drum axially opposing the outer surface of the drum, further comprising:

a plurality of lumens extending through, at least a portion of the drum wall, at least a portion of the grinders secured to the drum in the plurality of lumens and at least a portion of the cleats secured to the drum in the plurality of lumens.

12. The apparatus of claim 11, herein longitudinal grooves formed along the inner surface of the drum wall define a plurality of inner surface ridges, wherein the lumens extend through at least a portion of the inner surface ridges, wherein at least two of the inner surface ridges have a first wall thickness and define an inner groove there-between having a second wall thickness less than the first wall thickness to reduce an overall weight of the drum.

13. The apparatus of claim 1, wherein the drum is cylindrical and at least one cleat includes an outer surface defining a plane orthogonal to the outer surface of the drum such that the at least one cleat is capable of moving material when the drum is rotatably driven along the longitudinal axis of the drum.

14. The apparatus of claim 1, wherein multiple windings of the grinders along the first helical pattern are interdisposed with multiple windings of the cleats along the second helical pattern.

15. The apparatus of claim 1, wherein at least a portion of the second helical pattern is offset in parallel to at least a portion of the first helical pattern.

16. The apparatus of claim 1, wherein at least one of the at least partially box shaped cleats extends radially in a first direction from the outer surface of the drum and extends longitudinally along the outer surface of the drum in a second direction perpendicular to the first direction.

* * * * *